US006558743B1

(12) United States Patent
Crompton, Jr. et al.

(10) Patent No.: US 6,558,743 B1
(45) Date of Patent: May 6, 2003

(54) IN SITU FLUOROPOLYMER POLYMERIZATION INTO POROUS SUBSTRATES

(75) Inventors: John Russell Crompton, Jr., Middletown, DE (US); Robert Clayton Wheland, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/409,173

(22) Filed: Sep. 30, 1999

Related U.S. Application Data

(60) Provisional application No. 60/105,798, filed on Oct. 27, 1998.

(51) Int. Cl.[7] ..... B05D 7/08

(52) U.S. Cl. ..... 427/254; 427/303; 427/393; 427/408

(58) Field of Search ..... 427/393, 301, 427/302, 303, 408, 254

(56) References Cited

U.S. PATENT DOCUMENTS

| | | | | |
|---|---|---|---|---|
| 3,658,626 A | | 4/1972 | Berger et al. | 156/441 |
| 3,847,657 A | * | 11/1974 | Rieber et al. | |
| 3,912,449 A | | 10/1975 | Mares et al. | 8/120 |
| 3,962,171 A | | 6/1976 | Robbins | 260/33.8 F |
| 3,993,827 A | | 11/1976 | Dukert et al. | 428/251 |

(List continued on next page.)

FOREIGN PATENT DOCUMENTS

| | | | | |
|---|---|---|---|---|
| DE | 2108363 | * | 9/1972 | |
| EP | 0 890 579 | | 1/1999 | C08B/15/00 |
| FR | 2110385 | * | 7/1972 | |
| FR | 2.148.432 | | 3/1973 | C08F/3/00 |
| FR | 2.156.786 | | 6/1973 | D06M/15/00 |
| FR | 2 614 047 | | 10/1988 | D06M/14/04 |
| JP | 61-86972 | | 2/1986 | B05D/7/06 |
| JP | 5-318413 | | 12/1993 | B27K/3/15 |
| JP | 93318413 | | 12/1993 | B27K/3/15 |
| RU | 1551763 | * | 3/1990 | |
| WO | WO 93/11293 | | 6/1993 | D06M/14/16 |

OTHER PUBLICATIONS

JP61086972 abstract—Database WPI, AN 1986–153122, Imparting oil and water repellency to wood—by co–graft polymerising high fluorinated monomers and vinyl monomers into wood surface, *Derwent Publications,* Feb. 5, 1986.

Arefi, F. et al., Evolution des proprietes physicochimiques et dielectriques d'un materiau poreux type papier par encapsulation polymerique de 1,1 difluorethylene sous decharge couronne a la pression atmospherique, *Revue Internationale Des Hautes Temperatures Et Des Refractaires,* 23, 205–210, 1986.

JP62059688 abstract—Database WPI– AN 1987–113251, Water Oil Repel Composition Contain Fluorine Based Water Oil Repel Polyether Type Fluorine Oil, *Derwent Publications Ltd.,* Mar. 16, 1987.

Wegner, Theodore H. et al., Wood, *Kirk–Othmer Encyclopedia of Chemical Technology,* 24, 579–611, 1984.

Robinovitz, Karen, Too Tough To Take A Spill, *The New York Times,* Section 9, p. 3, col. 2, Oct. 11, 1998.

*Primary Examiner*—Erma Cameron

(57) ABSTRACT

The present invention relates to in situ polymerization of fluoropolymer into porous substrates, to improve resistance to degradation by wetting and staining, and wood, to improve resistance to degradation, staining and warping.

12 Claims, 4 Drawing Sheets

U.S. PATENT DOCUMENTS

| | | | | | |
|---|---|---|---|---|---|
| 4,737,571 | A | | 4/1988 | Hodge et al. | 528/336 |
| 4,901,389 | A | | 2/1990 | Poulenard et al. | |
| 5,073,440 | A | | 12/1991 | Lee | 428/224 |
| 5,114,652 | A | | 5/1992 | Lee | 264/184 |
| 5,116,650 | A | | 5/1992 | Bowser | 428/34.2 |
| 5,156,780 | A | | 10/1992 | Kenigsberg et al. | 264/22 |
| 5,217,802 | A | * | 6/1993 | Scarmoutzos | 428/304.4 |
| 5,296,543 | A | | 3/1994 | Kosawski et al. | 524/606 |
| 5,418,006 | A | | 5/1995 | Roth et al. | 427/154 |
| 5,462,586 | A | | 10/1995 | Sugiyama et al. | 96/13 |
| 5,698,303 | A | | 12/1997 | Caldwell | 428/215 |
| 5,721,283 | A | | 2/1998 | Howard, Jr. et al. | 521/60 |
| 5,773,098 | A | | 6/1998 | Thomas | 427/490 |
| 5,789,523 | A | | 8/1998 | George et al. | 528/170 |
| 5,840,775 | A | | 11/1998 | Howard, Jr. et al. | 521/64 |
| 6,071,602 | A | | 6/2000 | Caldwell | 428/224 |
| 6,289,841 | B1 | | 9/2001 | Caldwell | 118/33 |
| 6,306,989 | B1 | | 10/2001 | Bloom et al. | 526/200 |

* cited by examiner

IN SITU FLUOROPOLYMER POLYMERIZATION INTO POROUS SUBSTRATES

This application claims priority benefit of U.S. Provisional Application No. 60/105,798 filed Oct. 27, 1998, now pending.

FIELD OF THE INVENTION

This invention relates to the polymerization of fluoropolymers into substrates comprising wood and wood by-products substrates. The fluoropolymer/substrate network that results is present on the surface of the substrate and is also deposited into the substrate at appreciable depths. The substrate/fluoropolymer networks provide a protective coating for the substrate.

TECHNICAL BACKGROUND OF THE INVENTION

Wood, like other porous materials has a host of uses. Common uses for wood include use as a building material and for the production of furniture. Materials comprising wood may degrade by staining and wetting. Materials comprising wood degrade by staining, wetting and warping. It is desirable to treat porous wood substrates such that they are more resistant to degradation. It is also desirable to treat wood such that the wood is more resistant to decay and degradation by staining, wetting and warping, and to improve durability while maintaining the appearance of wood.

For many years, textiles have been chemically treated to improve water and oil repellency. Different applications are commercially available to protect different kinds of substrates from oil and water staining. For example, Scotchgard®, sold by the 3M Company, and Zonyl®, sold by E. I. du Pont de Nemours and Company, are available to consumers for use with textiles and fabrics. However, these methods have not been applied to wood substrates.

There are several references which have used fluoro-compounds in wood to enhance the properties of wood. For example, U.S. Pat. No. 3,962,171 discusses a protective coating composition. The composition is used for painted and unpainted metal, plastic and wood surfaces. The method comprises preparing a mixture of a solution of 20 parts of granular polytetrafluoroethylene in Freon®. The composition is sprayed onto an acrylic painted surface, dried and wiped to form a transparent coating.

The use of granular fluoro-compounds is also discussed in Japanese Patent 05318413. The invention involves a method whereby a raw wood material is impregnated with a fluorinated microparticles having a diameter of 5 microns and a compound which changes to insoluble cured resin. The compound is cured to fix the microparticles with the resin. The uses and advantages listed in the abstract include use as building materials, woody appearance, contamination resistance, moisture and water resistance. The invention does not teach polymerization of a fluoro-compound into the wood as the present invention does.

Other references include the treatment of microporous materials with fluoroacrylate to achieve permanent water and oil repellency. For example, U.S. Pat. No. 5,156,780 teaches a method for treating microporous substrates to achieve water and oil repellency while maintaining porosity. In the '780 method, the substrates are impregnated with a solution of monomer in a carrier solvent. The carrier solvent is first substantially removed from the substrate for the express purpose of leaving the monomer as a thin conformal coating on all internal and external substrate surfaces. In this manner, the monomer is converted to polymer and the polymer does not block the pores or restrict flow in subsequent use as a filtration membrane.

It is desirable to treat the wood such that the wood is more resistant to staining, warping and wetting. It is also desirable to treat other porous substrates such that the other substrates are more resistant to degradation by staining and wetting.

The present invention teaches a fluoropolymer/substrate composition wherein the presence of fluoropolymer functions as a protective material for the substrate. The method used leaves the initiator and the initiator carrier solvent in the substrate during polymerization and uses undiluted monomer or, in its preferred embodiment, gaseous monomer, with the intention of penetrating and blocking all pores to the greatest depth possible. The object of the present invention is to provide a method for treating the substrate such that the presence of the fluoropolymer/substrate composition decreases or eliminates penetration of agents causing degradation so as to increase the substrate's resistance to wetting by oil and water, reduce staining by oil, water, and common materials such as ketchup, and to improve durability. The fluoropolymer/wood networks of the present invention have decreased water absorption and have improved resistance to degradation, staining, wetting, and warping and may be used for building materials. The fluoropolymer/non-wood substrate networks of the present invention have improved resistance to staining and wetting.

SUMMARY OF THE INVENTION

Disclosed in the present invention is a process for preparing a fluoropolymer/substrate composition, comprising:

in the case of gaseous fluoromonomer (a) contacting a porous substrate with a solution comprising an initiator dissolved in a suitable solvent;

(b) exposing said substrate and said initiator to gaseous fluoromonomer, under polymerization temperature and pressure conditions, wherein the fluoromonomer polymerizes into said substrate;

or in the case of liquid fluoromonomer (a) preparing a solution comprising initiator and liquid fluoromonomer;

(b) contacting a porous substrate with said solution; and (c) polymerizing the liquid fluoromonomer under polymerization temperature and pressure conditions, wherein the fluoromonomer polymerizes into said substrate, optionally in the presence of gaseous fluoromonomer, into said substrate.

The present invention also provides for a composition of matter made by a process for preparing a fluoropolymer/substrate composition, comprising:

in the case of gaseous fluoromonomer (a) contacting a porous substrate with a solution comprising an initiator dissolved in a suitable solvent;

(b) exposing said substrate and said initiator to gaseous fluoromonomer, under polymerization temperature and pressure conditions, wherein the fluoromonomer polymerizes into said substrate;

or in the case of liquid fluoromonomer (a) preparing a solution comprising initiator and liquid fluoromonomer;

(b) contacting a porous substrate with said solution; and (c) polymerizing the liquid fluoromonomer under polymerization temperature and pressure conditions, wherein the fluoromonomer polymerizes into said substrate, optionally in the presence of gaseous fluoromonomer, into said substrate.

Another disclosure of this invention is a composition of matter, comprising: a substrate which further comprises polymerized fluoropolymer, wherein the substrate is an open pore structure with interconnecting pores throughout said substrate, and wherein the level of fluoropolymer within and on the surface of said composition is from about 0.1 percent to about 300 percent of the weight of said substrate.

DETAILED DESCRIPTION OF THE INVENTION

Figure 1:
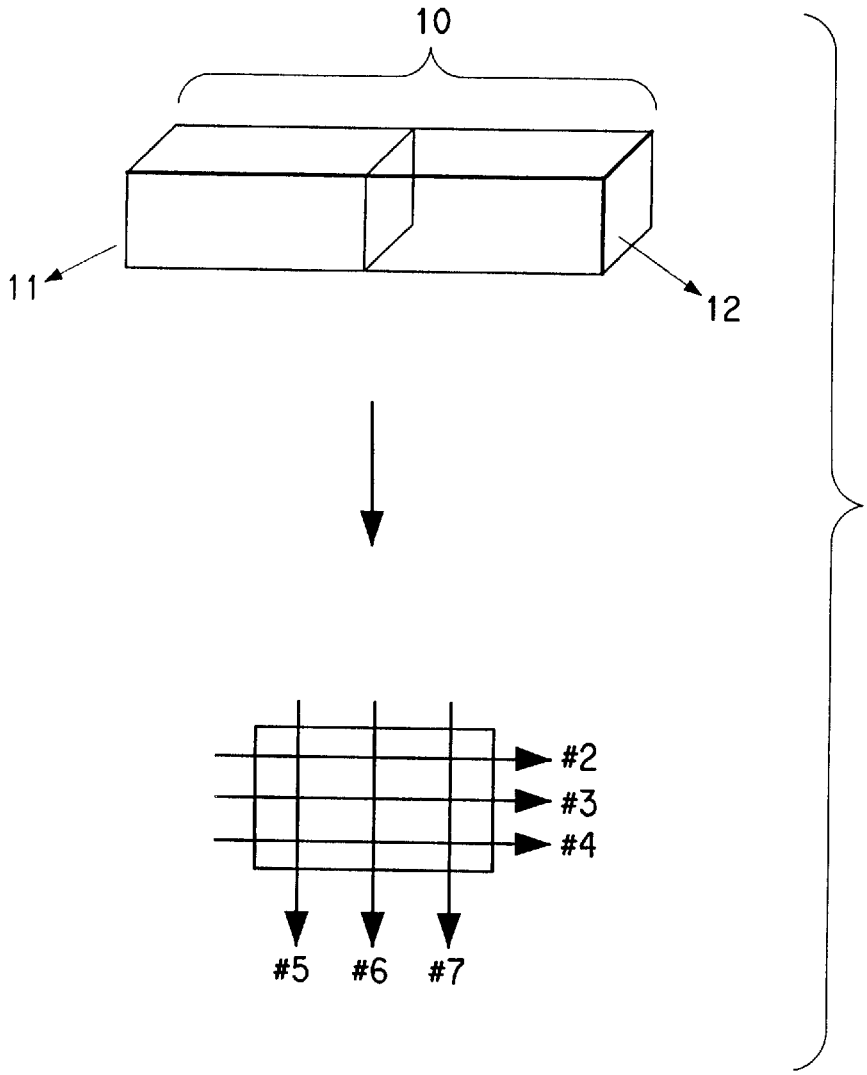
FIG. 1 is a depiction of a block of redwood as described in Example 2 in the present invention.

The present invention discloses a process for the in situ polymerization of fluoromonomer into porous substrates such as wood and wood by-products.

By porous substrate we mean any solid material penetrated throughout with interconnecting pores of a size such as to allow absorption of liquid initiator solution and monomer. This process works with any porous substrate that does not inhibit fluoromonomer polymerization. Substrates not inhibiting polymerization include wood and wood by-products. Whether a substrate will inhibit polymerization must be determined empirically substrate by substrate and may vary for the same substrate, depending upon prior finishing and treatment.

The present invention also provides a fluoropolymer/substrate wherein the substrates are open structures with interconnecting pores throughout their bulk and the level of fluoropolymer in the fluoropolymer/substrate composition is about 0.1 percent to about 150 percent of the weight of the substrate. Substrates useful in this invention include wood and wood by-products.

The most preferred substrate is wood and the most preferred level of fluoropolymer in the fluoropolymer/wood composition is about 0.5 percent to about 25 percent by weight of the wood.

When wood substrates are used in the present invention, the fluoromonomer polymerizes inside the pores of the wood so as to partially or fully block the pores. The process has been demonstrated with a preferred group of wood substrates comprising cedar, cherry, oak, pine, poplar, redwood, and walnut for which, in Example 1 below, ~8% to 25% of the void space available to water was filled with polytetrafluoroethylene (PTFE). In view of the broad range of woods with which this process has been demonstrated, the process should work well with most if not all woods.

The process of the present invention uses fluoromonomer in either the gaseous or liquid state. Gaseous monomers include tetrafluoroethylene (TFE), trifluoroethylene, vinylidene fluoride, chlorotrifluoroethylene, hexafluoroisobutylene and perfluoro methyl vinyl ether. Liquid monomers include 4,5-difluoro-2,2-bis(trifluoromethyl)-1,3-dioxole (PDD), perfluoro (2-methylene-4-methyl-1,3-dioxolane (PMD) and perfluoro propyl vinyl ether. These monomers may be homopolymerized or copolymerized to make compositions known to those skilled in the art. Examples include tetrafluoroethylene homopolymer and tetrafluoroethylene/perfluoro (2-methylene-4-methyl-1,3-dioxolane) copolymer. The preferred monomer is tetrafluroroethylene.

The process invention works for most organic initiators commonly used for fluoroolefin polymerizations, including, but not limited to, diacylperoxides, peroxides, azos and peroxydicarbonates. The preferred initiator is DP. DP has a half-life of about 4 hours at 20° C. which means that DP lasts long enough for a polymerization run to be set up at room temperature without excessive initiator loss and yet DP still reacts fast enough at room temperature for polymerizations to run to completion fairly quickly. Preferred run times are 4 to 24 hours.

In the preferred embodiment of this invention, the initiator is first dissolved in a solvent that is compatible with fluoroolefin polymerization. The resulting solution is then absorbed into the substrate. A non-exclusive list of suitable solvents includes chlorofluorocarbons, such as Freon® 113 ($CFCl_2CF_2Cl$), hydrofluorocarbons, such as Vertrel® XF ($CF_3CFHCFHCF_2CF_3$), perfluorocarbons, such as perfluorohexane, perfluoroethers, such as Fluorinert® FC-75, perfluoroamines, such as Fluorinert® FC 40, and perfluorodialkylsulfides, such as $CF_3CF_2CF_2CF_2SCF_2CF_2CF_2CF_3$. The preferred solvents for DP are Vertrel® XF and Freon® E1($CF_3CF_2CF_2OCFHCF_3$).

In this invention, the preferred initiator solution comprises a solution of hexafluoropropylene oxide dimer peroxide [hereinafter referred to as "DP"] in Freon® E1. It is further preferred that the fluoromonomer used in this process is tetrafluoroethylene. TFE polymerizes to form PTFE.

In the preferred embodiment of the process where the substrate is wood, the wood is soaked in a solution of free radical initiator. The wood is then removed from the initiator solution and the free liquid is allowed to drain away. By "free liquid" is meant solution that is not absorbed by the substrate during soaking. The initiator-soaked wood is then placed in an apparatus suitable for polymerization. The apparatus is filled with gas phase fluoromonomer, and the polymerization allowed to run. The preferred initiator when wood is used as a substrate is DP. The polymerization apparatus can be a simple plastic bag for atmospheric pressure polymerization or an autoclave for polymerization at pressures up to several hundred psi.

In the case of liquid fluoromonomer, such as PDD and PMD, the carrier solvent can be the monomer or the monomer containing a small amount of initiator solution (for example, DP in a Freon® solvent).

Polymerization temperatures range from 0° C. to 300° C. Substrates that retain their rigid pore structures at high temperatures and do not thermally decompose can be undergo the polymerization process of the present invention at much higher temperatures up to about 300° C. Room temperature polymerization is preferred for the process where wood substrates are used with the preferred fluoromonomer, TFE. In order to avoid discoloration and charring of the wood, the polymerization should not be run at temperatures much higher than 50° C.

Temperatures much lower than 0° C. are also undesirable because of the expense of refrigeration, and at least, in the case of chemical initiators, the uneconomic lengthening of reaction time and safety issues related to handling very low temperature initiators.

Polymerization pressure may vary. For gaseous monomers, pressures are generally from about 7 psia to about 500 psia. In the case of liquid monomers, such as PDD or PMD, the reaction is generally carried out under atmospheric pressure unless copolymers with TFE or other gaseous monomers are desired. In the absence of a pure gaseous monomer phase, oxygen should be excluded and an inert atmosphere, such as nitrogen, provided.

For an active monomer such as TFE, polymerization often deposits about 0.1 to 10 wt. % PTFE in the substrate at atmospheric pressure. Higher TFE pressures yield higher weight gains. When higher pressures are used, standard barricading must be employed to protect against TFE deflagration and runaway polymerization.

When the process disclosed by the pressent invention is used, a fluoropolymer/substrate ocmposition results and the substrate is protected by the presence of the fluoropolymer. The resulting composition has increased resistance to degradation, and durability is improved. When the preferred fluoromonomer, TFE, is used in the process for wood substrates, a PTFE/wood composition results and the wood is protected by the presence of the PTFE. PTFE polymerized into the wood increases the wood's resistance to wetting by oil and water, reduces staining by oil and water, decreases warpage and improves durability.

EXAMPLES

Example 1

Polymerization of (PTFE) into Different Woods
Decreased Water Absorption, Increased Durability A. Polymerization of TFE into wood A saw was used to cut samples of cedar, cherry, oak, pine, poplar, redwood, and walnut into cubes which measured roughly 0.75 inches on a side. Using glass jars, three cubes of each wood were soaked for 1 hour in ~50 ml of 0.185 M hexafluoropropylene oxide dimer peroxide (1, DP) at −15° C.

$$CF_3CF_2CF_2OCF(CF_3)(C{=}O)OO(C{=}O)CF(CF_3)OCF_2CF_2CF_3 \quad 1, DP$$

in Freon® E1 ($CF_3CF_2CF_2OCFHCF_3$). Each group of three cubes was air dried for about 30 seconds and then transferred to a 400 ml autoclave. In all cases the autoclave was chilled, evacuated, and filled with tetrafluoroethylene (TFE) gas. Fifty grams of TFE gas were charged in the case of cedar, cherry, pine, poplar, and redwood, but only 25 g were charged in the case of oak and walnut. The wood cubes were recovered, dried for 16 hours under pump vacuum, scraped with a spatula to remove loose polymer from the surface, and put under pump vacuum again until, after several days, a constant weight was achieved. Averaged over the three cubes of each wood type, weight gains from TFE polymerized into the wood as PTFE ranged from 14 to 95% as shown in Chart 1 below, wherein the woods are listed in order of decreasing sample weight and density. Most often, the less dense the starting wood, the greater the weight of PTFE deposited into the wood.

CHART 1
PTFE Weight Gains for Different Woods, Averaged over 3 Cubes

| Wood Type | Grams TFE Loaded to Autoclave | Average Cube Wt. Before | Average Cube Wt. After | Average Wt. Gain PTFE | Weight Gain As A Percent |
|---|---|---|---|---|---|
| Oak | 25 g* | 5.25 g | 6.01 g | 0.76 g | 14.5% |
| Walnut | 25 g* | 4.53 g | 5.45 g | 0.92 g | 20.3% |
| Cherry | 50 g | 4.34 g | 5.63 g | 1.29 g | 29.7% |
| Poplar | 50 g | 4.08 g | 5.65 g | 1.56 g | 38.2% |
| Pine | 50 g | 4.02 g | 5.73 g | 1.71 g | 42.5% |
| Cedar | 50 g | 2.81 g | 4.23 g | 1.42 g | 50.5% |
| Redwood | 50 g | 2.09 g | 4.08 g | 1.99 g | 95.2% |

*Strong exotherm and charring of the wood observed with 50 g TFE

B. Effect of PTFE on Water Absorption

For each wood type, cedar, cherry, oak, pine, poplar, redwood, and walnut, three cubes 0.75" on a side were assembled:

Cube #1: A cube from part A above containing polymerized PTFE

Cube #2: A cube from part A above containing polymerized PTFE, the surface of which has been lightly sanded to remove most visible traces of PTFE. In the discussion that follows these lightly sanded cubes are referred to as "PTFE/wood blocks".

Cube #3: A cube untreated except that it has been put under pump vacuum overnight to mimic the final devolatilization step of part A above. In the discussion that follows the blocks that were not chemically treated are referred to as the "control" blocks.

For each wood type, all three cubes were simultaneously immersed in distilled water in the same glass jar. In every case the control block showed an immediate darkening when immersed in water whereas the PTFE/wood blocks retained much of their natural color and appearance. The cubes were then periodically withdrawn, patted damp dry, weighed to determine the amount of water absorbed, and reimmersed in the water. A comparison of water absorption data of the control and PTFE/wood blocks after 600 cumulative hours of immersion in water is shown in Chart 2.

CHART 2
Affect of PTFE on Water Absorption After 600 Hours of Immersion

| Wood | Starting Wood Density | ML $H_2O$ Absorbed/ ML of Wood (Control) | ML PTFE/ ML of Wood (PTFE/wood) | ML $H_2O$/ ML of Wood (PTFE/Wood) | (ML PTFE + ML $H_2O$)/ ML Wood (PTFE/wood) |
|---|---|---|---|---|---|
| Oak | 0.76 g/ml | 0.60 ml | 0.048 ml | 0.52 ml | 0.57 ml |
| Walnut | 0.66 g/ml | 0.58 ml | 0.058 ml | 0.38 ml | 0.44 ml |
| Cherry | 0.63 g/ml | 0.64 ml | 0.081 ml | 0.42 ml | 0.50 ml |
| Poplar | 0.59 g/ml | 0.71 ml | 0.098 ml | 0.35 ml | 0.45 ml |

-continued

CHART 2
Affect of PTFE on Water Absorption After 600 Hours of Immersion

| Wood | Starting Wood Density | ML $H_2O$ Absorbed/ ML of Wood (Control) | ML PTFE/ ML of Wood (PTFE/wood) | ML $H_2O$/ ML of Wood (PTFE/Wood) | (ML PTFE + ML $H_2O$)/ ML Wood (PTFE/wood) |
|---|---|---|---|---|---|
| Pine | 0.58 g/ml | 0.63 ml | 0.11 ml | 0.32 ml | 0.43 ml |
| Cedar | 0.41 g/ml | 0.51 ml | 0.089 ml | 0.42 ml | 0.51 ml |
| Redwood | 0.30 g/ml | 0.52 ml | 0.13 ml | 0.20 ml | 0.33 ml |

All starting cubes measured about 1.90 cm on a side for a net volume of about 6.9 ml each. Densities were calculated, as shown in column 2, from the average weights in Chart 1. The weight of the water absorbed over the course of 600 hours of immersion divided by the volume of the wood sample (6.9 ml), gave the volume of water absorbed per milliliter of wood in the control blocks, as shown in column 3. There was little correlation between wood density and the volume of water absorbed. For example, although redwood was calculated to have less than half the density of oak, redwood absorbed slightly less water. Using the weight gains from Chart 1 and an assumption of about 2.3 g/ml for the PTFE, the volume of PTFE deposited per ml of wood in the PTFE/wood cubes was calculated, as shown in column 4. The weight of water absorbed by the PTFE/wood blocks over 600 hours of immersion was divided by 6.9 to calculate the volume of water absorbed per ml of wood in the PTFE/wood blocks (column 5). Wood samples that contained PTFE absorbed 13 to 62% less water (column 5) than the same wood cubes without PTFE (column 3). With the exception of cedar, the combined volume of PTFE and of water in the PTFE/wood blocks (column 6) was less than the volume of water absorbed by the control blocks (column 3). That is, in all cases but cedar, the PTFE did more than just fill void space that would otherwise be filled by water.

C. Effect of Repetitive Polymerization

Three cubes of poplar 0.75" on a side and with an average weight of 3.7942 grams were soaked for 15 minutes at −15° C. in 0.16 M DP in Freon® E1 which had been previously filtered through a 0.45$\mu$ filter. The soaked blocks, the average weight of which increased to 5.6650 grams in the soaking process, were briefly air dried and charged to a stainless steel autoclave. The autoclave was chilled, evacuated and further charged with 50 g of TFE. The autoclave was heated for 4 hours at 40° C. The cubes were recovered, lightly sanded to remove loose surface polymer, and dried at room temperature overnight with pump vacuum. The average cube weight was brought to 5.4960 g, which was a 45% weight increase compared to the starting weight.

The cubes were soaked a second time for 15 minutes in −15° C. 0.16 M DP solution. The average weight of the cubes was 5.7628 g. The cubes were reloaded into the 400 ml autoclave with 25 g of TFE. The autoclave was heated for 4 hours at 40° C. The cubes were recovered, lightly sanded, and dried under pump vacuum overnight. The average weight was brought to 6.383 g.

The cubes were soaked a third time in DP, reacted with 25 g TFE in a 400 ml autoclave tube, recovered, lightly sanded, and dried for 3 days at room temperature under pump vacuum. The average weight was brought to 6.4953 g, which was a 71.2% weight gain compared to the start.

One of the cubes was immersed in water along with an untreated poplar control cube. Once again weight gain was followed as a function of cumulative immersion time. Chart 3 compares the 600-hour water absorption results for the poplar cubes prepared in part C of this Example to the poplar cubes of part B of this Example. While the poplar cube exposed to three polymerization cycles contained almost twice as much PTFE as the cube exposed to a single polymerization cycle, no difference was detected in the amount of water absorbed after 600 hours.

CHART 3
Affect of PTFE on Water Absorption After 600 Hours of Immersion

| Wood | Starting Wood Density | ML $H_2O$ Absorbed/ ML of Wood (Control) | ML PTFE/ ML of Wood (PTFE/wood) | ML $H_2O$/ ML of Wood (PTFE/wood) | (ML PTFE + ML $H_2O$)/ ML Wood (PTFE/wood) |
|---|---|---|---|---|---|
| Poplar, 1X | 0.59 g/ml | 0.71 ml | 0.098 ml | 0.28 ml | 0.38 ml |
| Poplar, 3X | 0.55 g/ml | 0.83 ml | 0.17 ml | 0.28 ml | 0.45 ml |

D. Resistance to Prolonged Water Exposure

The soaking experiments described in part B of this Example were continued for 8 to 9 months at room temperature. After the wood cubes were removed from the water, the surfaces were wiped damp dry with a tissue. The PTFE containing wood samples were uniformly less darkened and less "wet" looking as recorded in the Chart 4 below.

CHART 4
Effect of Prolonged water Exposure

| Wood | Appearance of Water | Appearance of Untreated Wood | Appearance of PTFE/Wood |
|---|---|---|---|
| Oak | Yellow with black solids (fungi?) | Dark brown to black | Tan, more like starting wood |

-continued

CHART 4
Effect of Prolonged water Exposure

| Wood | Appearance of Water | Appearance of Untreated Wood | Appearance of PTFE/Wood |
|---|---|---|---|
| Walnut | Orange with black solids (fungi?) | Black | Brown with occasional black spots |
| Cherry | Yellow with black solids (fungi?) | Dark brown | Tan with occasional dark spots |
| Poplar | Pale yellow with black solids (fungi?) | Medium brown | Blonde, more like starting wood |
| Pine | Colorless | Light brown | Blonde, more like starting wood |
| Cedar | Yellow with black solids (fungi?) | Dark brown | Tan, much like starting wood |
| Redwood | Yellow with white solids | Dark brown | Tan, much like starting wood |

Example 2

Evidence for PTFE Penetration Inches Deep into Redwood

The experiments below establish that TFE polymerizes in wood at least inches below the wood surface and that, while deposition along the grain may be mildly favored, penetration occurs in other directions as well. Gaseous monomer, such as TFE, penetrates wood particularly easily.

A. Evidence for Deep Penetration

Two redwood blocks were cut so as to detect anisotropy in the penetration and polymerization of TFE. The first block measuring 10.8 cm×2.6 cm×1.8 cm was cut so that the grain of the wood ran in the 10.8 cm direction. It is referred to hereinafter as the "lengthwise" block. A second block measuring 11.0 cm×2.7 cm×1.8 cm was cut so that the grain of the wood ran in the 2.7 cm direction. It is referred to as the "crossgrain" block. It is supposed that if TFE can penetrate wood substrates only along the direction of the grain of the wood, then TFE must travel 5.4 cm to get to the center of the lengthwise block but only 1.35 cm to get to the center of the crossgrain block. The two blocks could thus differ greatly in PTFE weight gain and how any PTFE is distributed spatially. Each block was weighed and then soaked for 1 hour at −15° C. in 0.16 M DP in Freon® E1. The blocks were briefly air dried and then transferred to separate 400 ml stainless steel autoclaves. Each tube was charged with 50 g of TFE and heated for four hours at 40° C. The blocks were recovered, lightly sanded to remove loose PTFE from the surface, dried for at least 4 days under pump vacuum, and reweighed. The lengthwise block increased in weight from 17.9 g to 30.3 g for a 69% weight gain. The crossgrain block increased in weight from 16.0 g to 28.7 g for a 79% weight gain. The volume of PTFE picked up per ml of wood was 0.103 ml of PTFE for the crossgrain sample and 0.108 ml for the lengthwise sample. These results are likely the same within experimental error and are not much different from the 0.13 ml of PTFE per ml of wood reported above for the much smaller redwood cubes in Example 1. This experiment provided the first indication that grain direction did not dominate deposition, that PTFE deposition is not limited primarily to the wood surface, and that sample size did not dramatically affect results up to dimensions of several inches.

Untreated wood contains no fluorine while PTFE is 76% by weight fluorine. Thus, the concentration of PTFE in a treated wood sample is proportional to the wood's fluorine content. As illustrated in FIG. 1, the crossgrain sample (block 10 of FIG. 1) was sawed in half creating two new blocks (blocks 12 and 13 of FIG. 1), each measuring roughly 5.5 cm×2.7 cm×1.8 cm. The cut wood sample exposed the interior of the original block as two new faces. One of the two new block faces was scanned across its full width with the beam of an electron microscope set to a 50 micron spot size (scans #2–#7). The electron microscope was operated in energy dispersive mode so as to give an output signal proportional to the fluorine content of the wood. In this way microscopic variations in relative fluorine concentration (y axis) could be plotted across the full width of the wood block (x axis).

Scan #3 was in the direction of the wood grain (the 2.7 cm dimension) while scan #6 was perpendicular to the grain (the 1.8 cm direction). The scans showed choppy alternation between areas of high and low fluorine concentration which was attributed to random areas of cellulose, void and PTFE that were crossed by the beam during the scan. While high fluorine concentrations were observed throughout the bulk of the wood, fluorine concentrations were noticeably higher toward the surface of the wood in scans #3 and #6.

Figure 2:
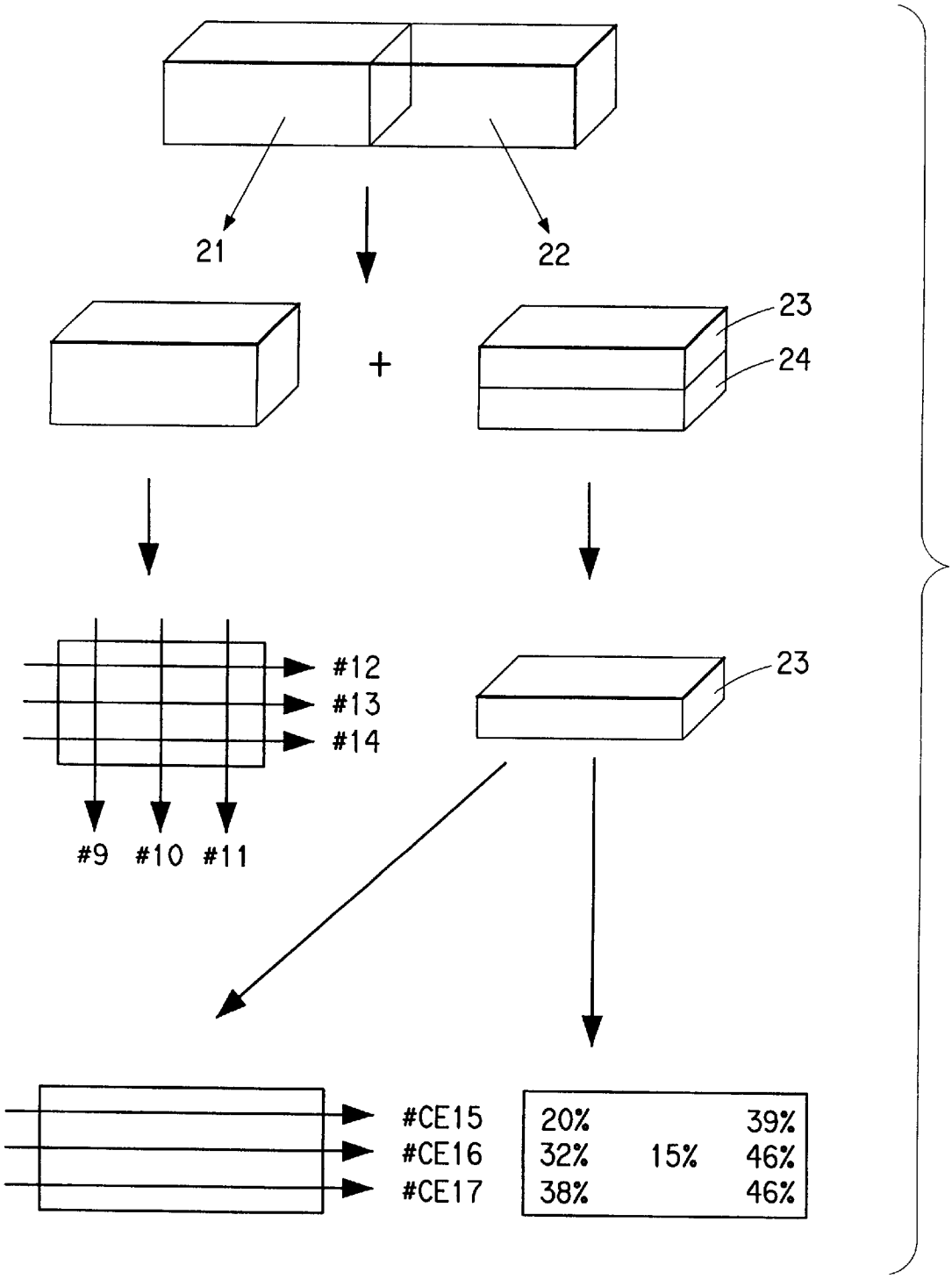
FIG. 2 is a depiction of the cross sectioning and x-ray scanning of a block of redwood as described in Example 2 in the present invention.

A similar analysis was then done on the lengthwise block. As shown in FIG. 2, the block (block 20 of FIG. 2) was first cut in half to create two new faces (blocks 21 and 22 of FIG. 2). One of the new faces was scanned with the beam of an electron microscope in energy dispersive mode to measure relative fluorine concentration as shown by the direction of the arrows in FIG. 2. Three scans were performed in the 1.8 cm direction (scans #9, #10, and #11)and three scans were performed in the 2.6 cm direction (scans #12, #13, and #14). All six scans performed were perpendicular to the wood grain. High and low fluorine concentrations alternated irregularly across the full width of all six scans. There was no discernable preference for fluorine at the surface. One of the two 5.4 cm×2.6 cm×1.8 cm blocks created by the first cut was cut into half again. Two additional blocks were created (blocks 23 and 24 of FIG. 2) that measured ~5.4 cm×2.6 cm×0.9 cm. The fresh cut face of one of the blocks was scanned three times along the grain of the wood, traveling each time the 5.4 cm distance from what had been the center of the original block to an outside end (scans #CE 15, #CE 16, and #CE 17). The fluorine concentrations increased 10 to 20 times from the center to the outer face of the block. Fluorine concentrations measured much lower at the center of the block for scan #CE16, than when scanned end on as in scans #9 through #14 of FIG. 2. Combustion analysis was used to resolve the inconsistency.

Three small wood chips were cut from the end of the block where electron microscopy had shown high concentrations and three small wood chips from the end of the block (i.e., the deep interior of the original block before the block was cut in the first instance) where electron microscopy had shown 10 to 20 times lower concentrations in FIG. 2 scans #CE15, #CE16, and #CE17, and one small wood chip was cut from the middle of the face. The weight percents of fluorine found by combustion analysis for all seven wood chips are provided in FIG. 2. The fluorine content varied from an average of 30 wt % in the deep interior of the block to an average of 44 wt % at the outer end of the block. Electron microscopy had shown the correct trend but in an exaggerated fashion. The exaggeration is attributed to the effects of wood morphology and angle of viewing on PTFE content. This example provides a basis for concluding that there is a mild preference for TFE polymerization along the direction of the wood grain and that penetration occurs easily to depths of at least 5.4 cm.

B. Morphology of PTFE Deposits within the Wood

As shown in FIG. 2, the redwood "lengthwise block" was cut into three pieces. A piece measuring ~5.4 cm×2.6 cm×0.9 cm and weighing about 4.5 g was digested chemically by heating it to reflux with 10 ml of concentrated sulfuric acid. Additional sulfuric acid was added to reduce the wood to an oily black residue. The carbon responsible for the black color was then burned away by the gradual addition of concentrated nitric acid. The residue was diluted with water, filtered, and dried. A white fibrous PTFE deposit was recovered. The residue accounted for 35.6% of starting sample weight, which was similar to the fluorine levels measured by combustion analysis. At 100× to 20,000× magnification, electron microscopy detected rod shaped structures 20 $\mu$–60$\mu$ across and of indefinite length. At 20,000× magnifications, the rods showed a spongy fine structure. Such spongy morphology is often seen when TFE is polymerized in the gas phase. Perhaps the void spaces in wood function as microscopic gas phase polymerization reactors for TFE. In this invention, the polymerization appears to have filled the pores in the wood substrates with spongy PTFE deposits rather than having deposited the PTFE as a conformal coating on the walls of the pores.

Example 3

Evidence for PTFE Penetration Inches Deep into Oak

Two oak blocks were cut so as to detect anisotropy in the penetration and polymerization of TFE. The first block which measured 12.1 cm×2.5 cm×1.9 cm, was cut so that the grain of the wood ran in the 12.1 cm direction. It will be referred to hereafter as the "lengthwise" block in this Example (block 40 of FIG. 4). A second block which measured 2.1 cm×2.5 cm×1.9 cm was cut so that the grain of the wood ran in the 2.5 cm direction. It will be referred to hereafter as the "crossgrain" block in this Example (block 30 of FIG. 3). To the extent that the TFE gas can penetrate the wood only along the direction of the grain, the TFE must travel 6.05 cm to get to the center of the lengthwise block but only 1.25 cm to get to the center of the crossgrain block. The two blocks could thus differ greatly in PTFE weight gain and how any PTFE is distributed spatially.

Each block was weighed and then soaked for 1 hour at −15° C. in 0.16 M DP in Freon® E1. The blocks were briefly air dried and then transferred to separate 400 ml stainless steel autoclaves. Each tube was charged with 25 g of TFE and heated for four hours at 40° C. The blocks were recovered, lightly sanded to remove loose PTFE from the surface, dried for at least 4 days under pump vacuum, and reweighed. The lengthwise block increased in weight from 44.36 to 47.98 g for an 8.1% weight gain. The crossgrain block increased in weight from 42.54 g to 49.81 g, or a 17.1% weight gain. The crossgrain sample picked up 0.05 ml of PTFE/ml of oak and the lengthwise sample picked up 0.03 ml of PTFE/ml of oak. This compares to 0.048 ml of PTFE per ml of oak in the case of the 0.75" oak cubes of Example 1. The ~2× greater deposition of PTFE in the crossgrain block suggested a mild preference for penetration in the direction along the wood's conductive tissues by which food and nutrients travel.

Cross section experiments were done next. The crossgrain sample was cut in half to create two new blocks (blocks 31 and 32 of FIG. 3). Each block measured roughly 6.05 cm×2.5 cm×1.9 cm. A 50$\mu$ spot size was used to scan one of the new faces by electron microscopy. The scans were performed in energy dispersive mode to measure relative fluorine concentrations in the direction of the arrows as shown in FIG. 3.

Figure 3:
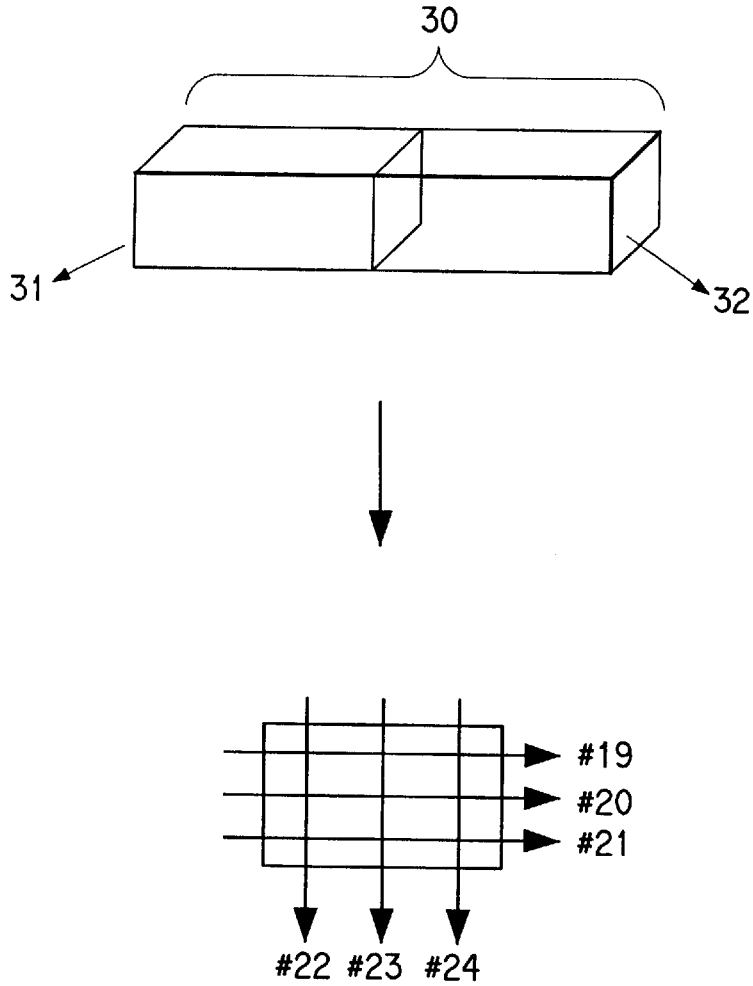
FIG. 3 is a depiction of a block of oak as described in Example 3 in the present invention.

Scans #19, #20, and #21 shown in FIG. 3 were in the direction of the wood grain (the 2.5 cm dimension) while scans #22, #23 and #24 were perpendicular to the grain (the 1.9 cm direction). All six scans showed choppy alternation between areas of high and low fluorine concentration which was attributed to the random crossing of areas of cellulose, void, and PTFE by the electron microscope beam. High PTFE concentrations occurred throughout the wood and were not clustered near the surface.

A similar analysis was then done on the lengthwise block. The block was first cut in half to create two new faces (blocks 41 and 42 of FIG. 4). One of the new faces was scanned by electron microscope in energy dispersive mode measuring relative fluorine concentration in the direction of the arrows in FIG. 4 below.

Figure 4:
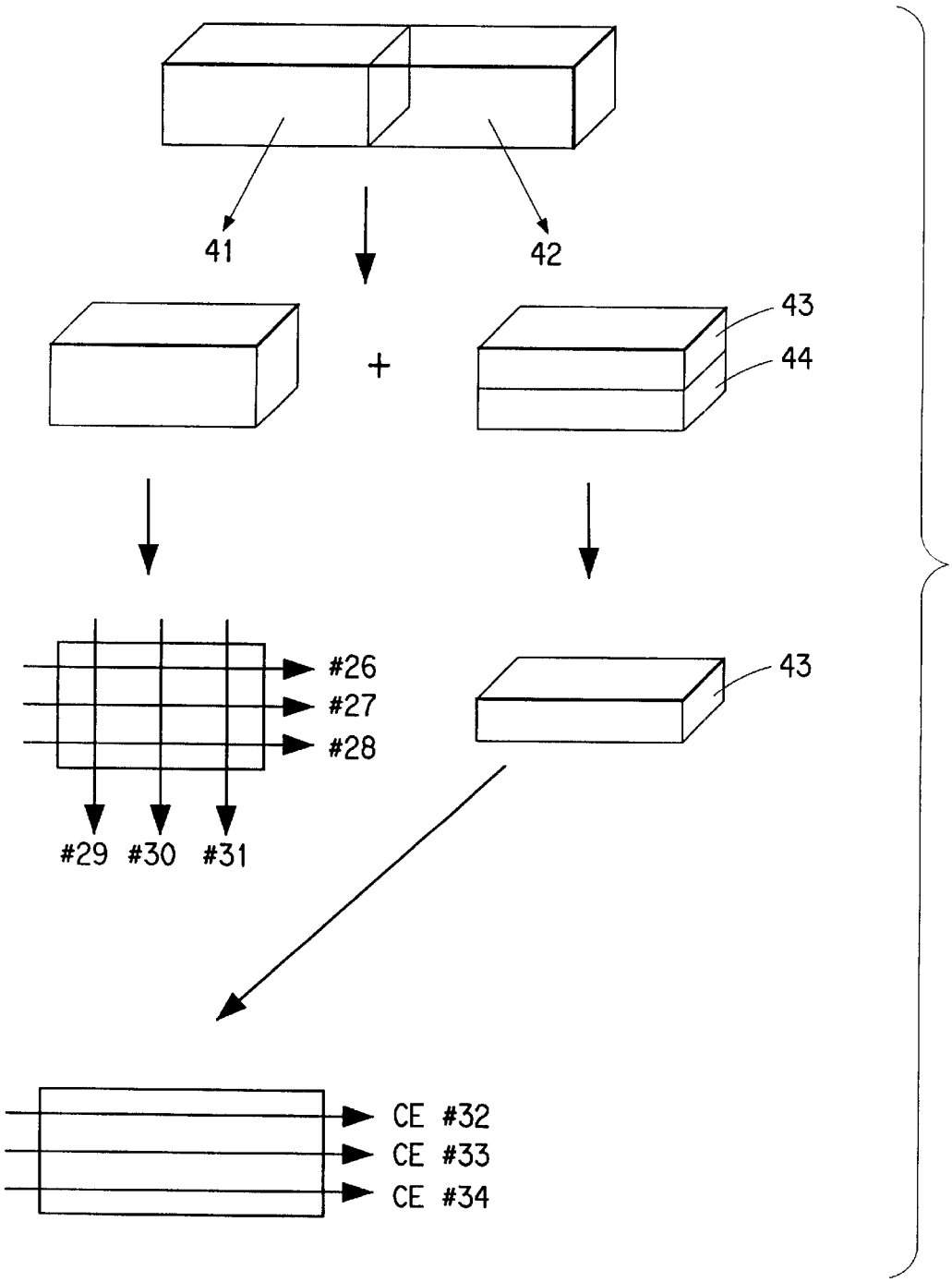
FIG. 4 is a depiction of the cross sectioning and x ray scanning of a block of oak as described in Example 3 in the present invention.

Three scans were performed in the 2.5 cm direction as indicated by the arrows #26, #27, #28 of FIG. 4 and three scans were performed in the 1.9 cm direction, indicated by the arrows #29, #30, and #31 of FIG. 4. All six scans were performed perpendicular to the wood grain. High and low fluorine concentrations alternated irregularly across the full width of all six scans. There was no discernable preference for fluorine at the surface. One of the two 6.05 cm×2.5 cm×1.9 cm blocks that was created by the first cut was cut in half again to create two more blocks (blocks 43 and 44 of FIG. 4). The blocks measured ~6.05 cm×2.5 cm×0.95 cm each. The fresh cut face of one was scanned three times along the grain of the wood, traveling each time the ~6.05 cm distance from what had been the center of the original block to an outside end, as indicated in arrows #CE32, #CE33, and #CE34 of FIG. 4. While the scans indicated by arrows #CE32, #CE33, and #CE34 showed very little fluorine towards the center of the block, high fluorine concentrations were detected at the center of the block in scans #26 to #31 of FIG. 4. As in the redwood block of Example 2, the same dependence of fluorine concentration upon scan direction was seen and elemental analysis was used to support the higher fluorine concentrations. It was concluded that there was a mild preference for TFE polymerization along the direction of the wood grain and that penetration easily occurred to depths of at least 6 cm.

Example 4

Protection of Wood

A. High Pressure Process

A 3.8 cm×8.6 cm rectangle was cut from each of the six types of wood in a package of Band-it® Real Wood Variety Veneer (Cloverdale Company, Inc., P. O. Box 400, Cloverdale, Va. 24077). While the exact identities of the woods were unknown, their visual appearance suggested common woods such as walnut, pine, maple, and redwood. All six rectangles were notched so as to enable later identification and weighed and then soaked for one hour at −15° C. in 0.175 M DP in Freon® E1. The strips were briefly air dried and loaded into a pre-chilled 400 ml autoclave along with 50 g tetrafluoroethylene gas. As the autoclave was warmed towards 40° C., pressure peaked at 261 psi at 20.7° C. and then decreased to 74 psi at 38.5° C. at the end of the run, about four hours later. All six strips became heavily coated with PTFE. Loose PTFE was removed from the surface and residual volatiles were removed. The surface of the wood still appeared white. Weight gains of 38%, 66%, 70%, 89%, 97%, and 145% were observed for the six different types of wood samples. The samples that showed weight gains of 38%, 66%, 97%, and 145% were sanded to return the wood to a reasonably natural surface appearance. Those samples were then spotted with Lea & Perrins® Worcestershire Sauce, Pathmark® Yellow Mustard, and Pathmark® Tomato Ketchup. After 5 to 10 minutes, the wood samples were wiped clean with a tissue and any residual moisture was allowed to air dry. No stains were readily apparent to the eye. The original starting woods that were not treated with TFE were stained by Worcestershire Sauce, Mustard, and Ketchup under the same conditions. The samples were compared to the starting woods. The wood/PTFE compositions prepared in this example were more resistant to staining, more easily cleaned, and more durable.

B. Low Pressure Process

A 30 mm×40 mm rectangle was cut from each of the six types of wood in a package of Band-it® Real Wood Variety Veneer (Cloverdale Company, Inc., P.O. Box 400, Cloverdale, Va. 24077). While the exact identities of the woods were unknown, their visual appearance suggested common woods such as walnut, pine, maple, and redwood. All six rectangles were notched so as to enable later identification and weighed. The strips were soaked for one hour at −15° C. in 0.165 M DP in $CF_3CFHCFHCF_2CF_3$, briefly air dried, loaded into a 20.3 cm×25.4 cm zip lock polyethylene bag (Brandywine Bag Co., part number 301630) equipped with a polypropylene gas inlet valve, and the bag was clamped shut. The bag was taped to a rectangular wire frame attached in turn to an ordinary laboratory stirrer motor. The bag was evacuated/purged three with $N_2$ and two times with TFE and then inflated loosely with TFE gas. For the next ~18 hours the bag and its contents were slowly tumbled using the stirrer motor mounted in a horizontal position. The wood strips were unchanged in visual appearance. The strips were devolatilized for 72 hours under pump vacuum and reweighed. The strips had a weight gains of 0.9 wt % to 7 wt % as shown in Chart 5, column 2. Drops of water were placed on the wood and advancing contact angles measured about 10 minutes later. Advancing contact angles were uniformly high, 120° to 127° (Chart 5, column 3), indicative of PTFE at the surface. The behavior of the untreated control samples containing no polymerized PTFE was markedly different. While reasonably high contact angles of 90 to 122° were observed for the untreated control wood samples initially (Chart 5, column 5), these contact angles could be observed only briefly because the water droplets started to spread out over the surface after only about 15 seconds to 2 minutes (Chart 5, column 6). The PTFE treated and the control samples were next submerged in water at room temperature and then air dried to observe what effect the PTFE treatment had on warpage.

Before any exposure to water, PTFE, or other chemicals, the Band-it® Real Wood Variety Veneer starts off with a slight curvature, the decorative wood surface being on the convex side. Under immersion conditions, both the PTFE and control samples wet through with water. PTFE treated samples remained reasonably flat after 375 minutes of water immersion. After air drying overnight, five out of six of the untreated control samples noticeably curled back on themselves creating semicircular or even tubular shapes (Chart 5, column 7) while the PTFE treated samples varied from slight curling to flattening (Chart 5, column 4). Three of the untreated control samples also showed mild water staining while none of the PTFE treated samples showed any visible water marks.

CHART 5
Water Contact Angles and Warpage for Low Pressure Polymerization Samples

| | Wood with Polymerized PTFE | | | Untreated Wood Controls | | |
|---|---|---|---|---|---|---|
| Wood | PTFE Weight Gain | Contact Angle with $H_2O$ | Immerse in $H_2O$ Then Dry Overnight | Initial Contact Angle | Time for Wetting | Immerse in $H_2O$ Then Dry Overnight |
| #1 | 0.9% | 120° | Slight Flattening | 110° | ~2 min | No Effect on Shape, Slight Stain |
| #2 | 2% | 123° | Curled to Semicircle | 110° | ~2 min | Nearly Tubular, Slight Stain |
| #3 | 3% | 127° | Flattened | 122° | ~2 min | Slight Curling |
| #4 | 4% | 127° | Slight Curling | 115° | ~2 min | Slight Curling, Slight Stain |
| #5 | 5% | 122° | Slight Flattening | 105° | ~15 sec | Nearly Tubular |
| #6 | 7% | 122° | Flattened | 90° | ~15 sec | Slight Curling |

In a final test, a drop of Squibb mineral oil 1 to 3 mm in diameter was placed on all the control and PTFE treated samples. The mineral oil immediately wetted and spread out over the surface of the control samples leaving a large oily mark. In contrast the mineral oil beaded up on the PTFE treated samples. After waiting 10 to 15 minutes, the oil droplet was wiped off the PTFE treated samples leaving an oily mark visible only where the oil droplet had contacted the wood. Both the control and PTFE treated samples were then repeatedly rinsed with Freon® 113 ($CF_2ClCCl_2F$) and air dried. All the untreated samples still showed a faint patch of darker wood 20 mm to 40 mm in maximum dimension where the oil had been. Of the PTFE treated woods, only wood #6 showed a faintly darker patch 8 mm in diameter where the oil had been.

TFE polymerized into the wood makes the wood harder to wet by oil and water, less subject to staining by oil and water, and less subject to warpage when wetted and then dried.

Example 5

Liquid Phase Perfluoromonomer

A. In Wood Under Inert Atmosphere

A jar was chilled to about −15° C. and 25 ml of PMD and 2 ml of ~0.16 M DP in $CF_3CF_2CFHCFHCF_3$ solvent were added. A cube of redwood ~1.9 cm on a side weighing 2.46 g was immersed in the solution contained in the jar for about 1 hour at −15° C. The redwood cube was removed, allowed to drain and then transferred to a 20.32 cm×25.4 cm zip lock polyethylene bag (Brandywine Bag Co., part number 301630) equipped with a polypropylene gas inlet valve. The bag was clamped shut, inflated and evacuated 3 times with nitrogen, and allowed to sit over the weekend. The cube was removed and a few pieces of white polymer rubbed off its surface with a spatula. After devolatilizing for 9 days under pump vacuum at room temperature, the cube weighed 4.45 g for a 81% weight gain. One side of the cube was lightly sanded revealing an attractive brown surface slightly darker in appearance. A drop of water placed on the surface remained there for about two hours until it evaporated. A drop of water placed on an untreated redwood cube wet the surface within a minute and took about 30 minutes to soak into the cube, having spread out into a visibly large wet area on the cube.

B. In Wood Under TFE Atmosphere

A cube of redwood, ~1.9 cm on a side and weighing 2.27 g was immersed in the PMD/DP solution left over from part A of this Example for 1 hour at −15° C. The redwood cube was removed, allowed to drain and then transferred to a 20.32 cm×25.4 cm zip lock polyethylene bag (Brandywine Bag Co., part number 301630) equipped with a polypropylene gas inlet valve. The bag was clamped shut, inflated and evacuated three times with nitrogen, inflated and evacuated three times with TFE, loosely inflated with TFE, and allowed to sit over a three days. The cube was removed along with 2.9 g of PTFE. Most of the PTFE removed was loose but some of it was scraped off of the redwood cube. After devolatilizing for 9 days under pump vacuum at room temperature, the cube weighed 4.51 g for a 99 percent weight gain. One side of the cube was light sanded revealing an attractive silvery brown surface darker in appearance than at the start. A drop of water placed on the surface remained on the surface of the cube for about two hours until it evaporated. A drop of water placed on an untreated redwood cube wet the surface of the cube within a minute and took about 30 minutes to soak into the cube, having spread out into a visibly large wet area on the cube.

Example 6

Penetration and Deposition of Fluoropolymer

Lumber is most often cut with the wood grain running lengthwise. For monomer and initiator to thoroughly penetrate a long board, much of this penetration must either occur perpendicular to the wood grain or else monomer and initiator must be able to enter at the ends and travel rapidly down the wood grain. The experiments below show that significant penetration and PTFE deposition occurs perpendicular to the wood grain.

A. PTFE Deposition Perpendicular to Wood Grain

A block of pine measuring 14.5 cm×2.6 cm×1.9 cm and with the grain running lengthwise was cut roughly in half creating two new blocks: Block A measuring ~7.0×2.6×1.9 cm and weighing 16.1 g and Block B measuring ~7.4×2.6×1.9 cm and weighing 17.2 g. Using Epoxy-Patch® cement (Hysol Engineering Adhesives, The Dexter Corporation, Seabrook, N.H.) 2.6×1.9 cm patches of aluminum foil (Reynolds Wrap®, Reynolds Metal Company, Richmond, Va.) were glued to the far ends of Block A. After 3 days of drying, Block A (plus foil) weighed 16.5 g. The purpose of the aluminum foil was to block entry and travel by initiator and monomer in the direction of the wood grain to test for ease of perpendicular penetration. Blocks A and B were immersed for 1 hour at −15° C. in ~0.16 M DP in $CF_3CF_2CF_2OCFHCF_3$ solvent. The blocks were removed, briefly drained, chilled on dry ice, and loaded into a chilled (less than −20° C.) 400 ml autoclave. The autoclave was evacuated and loaded with 50 g of TFE. After four hours at 40° C., the wood blocks were recovered, trace loose PTFE wiped off the surface with a tissue, and the blocks were dried under pump vacuum for 3 days. Block A weighed 23.9 g for a 46% weight gain and Block B weighed 25.0 g for a 45% weight gain. Thus, PTFE deposition was not particularly dependent upon the direction of the wood grain; or upon which wood surfaces (end grain or non-end grain) were exposed to initiator and TFE.

What is claimed is:

1. A process for preparing a fluoropolymer/substrate composition, comprising:

in the case of gaseous fluoromonomer (a) contacting a porous substrate with a solution comprising an initiator dissolved in a solvent;

(b) exposing said substrate and said initiator to gaseous fluoromonomer, under polymerization temperature and pressure conditions, wherein the fluoromonomer polymerizes inside the pores of said substrate;

or in the case of liquid fluoromonomer (a) preparing a solution comprising initiator and liquid fluoromonomer;

(b) contacting a porous substrate with said solution; and (c) polymerizing the liquid fluoromonomer under polymerization temperature and pressure conditions, wherein the fluoromonomer polymerizes inside the pores of said substrate, optionally in the presence of gaseous fluoromonomer;

wherein the polymerized fluoromonomer in the substrate partially or completely fills the substrate.

2. The process of claim 1 wherein the porous substrate is selected from the group consisting of wood and wood-by-products.

3. The process of claim 2 wherein the substrate is selected from the group consisting of cedar, cherry, oak, pine, poplar, redwood and walnut.

4. A process of claim 1 wherein the fluoromonomer is selected from the group consisting of tetrafluoroethylene, trifluroroethylene, vinylidene fluoride, chlorotrifluoroethylene, 4,5-difluoro-2,2-bis(trifluoromethyl)-1,3-dioxole, and perfluoro(2-methylene-4-methyl-1,3-dioxolane).

5. The process of claim 1 further comprising at least one additional monomer selected from the group consisting of hexafluoroisobutylene, perfluoro methyl vinyl ether, and perfluoro propyl vinyl ether.

6. The process of claim 1 wherein the initiator is selected from the group consisting of diacylperoxides, peroxides, azos, and peroxydicarbonates.

7. The process of claim 5 wherein the initiator is hexafluoropropylene oxide dimer peroxide (DP).

8. The process of claim 1 wherein the solvent is selected from the group consisting of chlorofluorocarbons, hydrofluorocarbons, perfluorocarbons, perfluoroethers, perfluoroamines and perfluorodialkylsulfides.

9. The process of claim 1 wherein the polymerization temperature ranges from about 0° C. to about 300° C.

10. The process of claim 9 wherein the temperature is about 0 to about 100° C.

11. The process of claim 9 wherein the temperature is about 5° C. to about 30° C.

12. The process of claim 1 wherein the polymerization pressure is about 7 psia to about 500 psia.

* * * * *